United States Patent [19]

Murakami

[11] 4,207,791

[45] Jun. 17, 1980

[54] AUTOMATIC TUNING DEVICE

[75] Inventor: Keiji Murakami, Okegawa, Japan

[73] Assignee: Kabushiki Kaisha Kawai Gakki Seisakusho, Hamamatsu, Japan

[21] Appl. No.: 916,074

[22] Filed: Jun. 16, 1978

[30] Foreign Application Priority Data

Jun. 25, 1977 [JP] Japan ..... 52-75918
Aug. 8, 1977 [JP] Japan ..... 52-94793

[51] Int. Cl.[2] ..... G10H 1/02

[52] U.S. Cl. ..... 84/1.01; 84/454; 84/DIG. 18; 331/16; 324/78 Z

[58] Field of Search ..... 84/1.01, 1.03, 454, 84/DIG. 10, DIG. 18; 331/16; 324/78 Z, 82, 83 FE

[56] References Cited

U.S. PATENT DOCUMENTS

| | | | |
|---|---|---|---|
| 3,806,826 | 4/1974 | Schlosser | 331/16 |
| 3,861,266 | 1/1975 | Whitaker | 84/454 |
| 3,943,814 | 3/1976 | Wemetkamp | 84/1.01 |
| 3,956,961 | 5/1976 | Peterson | 84/DIG. 10 |
| 3,968,719 | 7/1976 | Sanderson | 84/454 |
| 4,105,946 | 8/1978 | Ikeda | 331/16 |
| 4,136,595 | 1/1979 | Gillette | 84/1.01 |
| 4,145,667 | 3/1979 | Messerschmitt | 381/16 |
| 4,168,645 | 9/1979 | Squire et al. | 84/1.01 |

*Primary Examiner*—Gene Z. Rubinson
*Assistant Examiner*—William L. Feeney

[57] ABSTRACT

An automatic tuning device for use in a synthesizer of an electronic musical instrument in which an error signal is produced corresponding to an output tone signal from each of a plurality of voltage controlled oscillators and added to the input thereto for automatic tuning. The automatic tuning device has a selector circuit from tone signal inputs from the voltage controlled oscillators a tone signal of an address assigned by an address counter, a period measuring counter which is controlled to start counting when the output signal from the selector circuit has reached a predetermined level for the first time after input of a start signal, to generate a control signal when the counting has reached a preset value and to stop the counting when the output signal from the selector circuit has reached a predetermined level for the first time after the generation of the control signal, and a memory circuit for storing the count value of the period measuring counter at the time of stopping the counting at an address assigned by the address counter. The count value thus stored in the memory circuit is converted into an analog form to provide an error signal of a designated one of the voltage controlled oscillators.

3 Claims, 13 Drawing Figures

P
S
J
K
Q0
Q1
Q2
Q3
START CKT. 12
(DELAY CKT. 16)
LATCH
ADDRESS COUNTER
LATCH
TRIGGER
TRIGGER
RESET
t0
t1
t2
t3
t4
t5
t6
t7
t8

FIG. 4B SIG. FROM VCO.
FIG. 4C CONT. CKT. (1) 13
FIG. 4D CONT. CKT. (2) 14

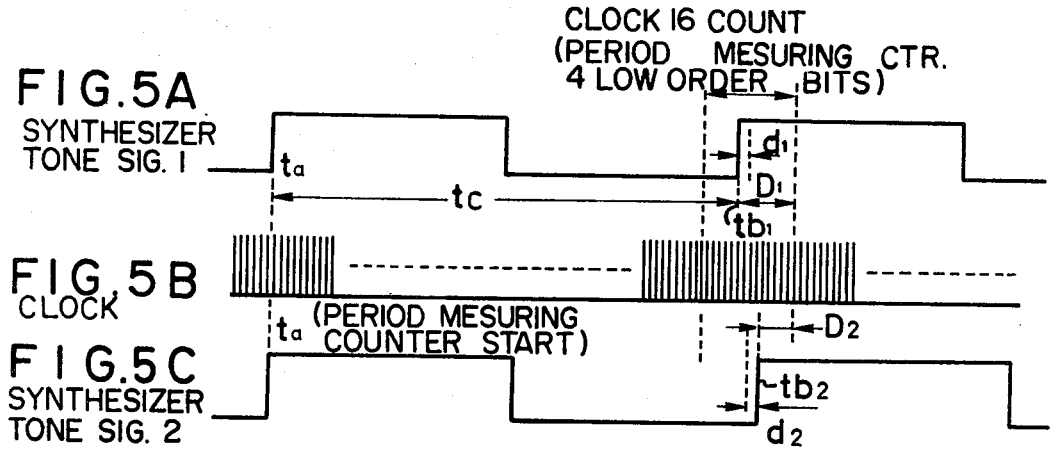
CLOCK 16 COUNT
(PERIOD MESURING CTR.
4 LOW ORDER BITS)
FIG.5A
SYNTHESIZER
TONE SIG. 1
ta
tc
d1
D1
tb1
FIG.5B
CLOCK
ta (PERIOD MESURING
COUNTER START)
D2
FIG.5C
SYNTHESIZER
TONE SIG. 2
tb2
d2
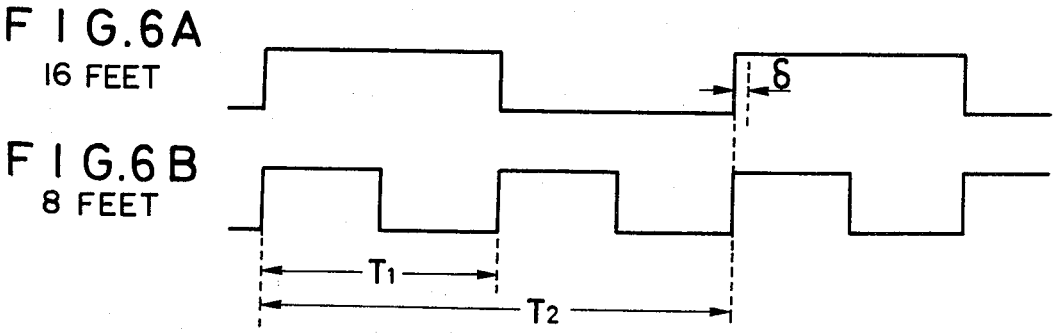
FIG.6A
16 FEET
δ
FIG.6B
8 FEET
T1
T2

AUTOMATIC TUNING DEVICE

BACKGROUND OF THE INVENTION

1. Field of the Invention

This invention relates to an automatic tuning device for automatically tuning an output tone signal from one or more voltage controlled oscillators on the basis of an error signal with respect to a designated value.

2. Description of the Prior Art

For an automatic tuning device employed in a synthesizer of an electronic musical instrument, there have heretofore been proposed a variety of systems of automatically tuning an output tone signal from a voltage controlled oscillator. Those of the conventional systems which employ an analog signal processing method have the defect that the device is inevitably bulky and expensive. A system using a digital processing method is a phase lock loop, but has the disadvantage that, in the case of tuning several synthesizers, if different foot ratios are selected for the individual synthesizers, a frequency divider must be inserted for each foot ratio.

SUMMARY OF THE INVENTION

This invention has for its object to provide an automatic tuning device which is free from the abovesaid defects of the prior art and which employs the digital signal processing method and is designed to produce an error signal with a simple construction and with the same accuracy regardless of the foot ratios selected for individual synthesizers.

The above object is achieved by providing an automatic tuning device in which an error signal is produced corresponding to an output tone signal from each of a plurality of voltage controlled oscillators and added to the input thereto for automatic tuning, and in which there are provided a selector circuit for selecting from tone signal inputs from the plurality of voltage controlled oscillators a tone signal of an address assigned by an address counter, a period of measuring counter controlled to start counting when the output signal from the selector circuit has reached a predetermined level for the first time after input of a start signal, to generate a control signal when the counting has reached a preset value and to stop the counting when the output signal from the selector circuit has reached a predetermined level for the first time after the generation of the control signal, and a memory circuit for storing the count value of the period measuring counter at the time of stopping of the counting at an address assigned by the address counter, and in which the count value thus stored in the memory circuit is converted into an analog form to provide an error signal of a designated one of the voltage controlled oscillators.

BRIEF DESCRIPTION OF THE DRAWINGS

FIGS. 5 and 6 are explanatory of the principles of automatic tuning of this invention.

DESCRIPTION OF PREFERRED EMBODIMENTS

Figure 1:
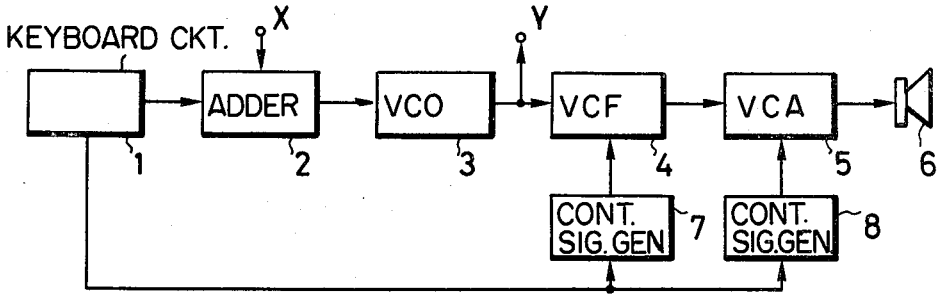
FIG. 1 is a block diagram explanatory of the outline of a synthesizer to which this invention is applied.

FIG. 1 shows in block form a synthesizer to which this invention is applied. In FIG. 1, a keyboard circuit 1 produces a pitch determining voltage signal and a keying signal, by the depression of a selected key, for input to an adder 2, in which the pitch determining voltage signal is added with an error signal X from an automatic tuning device of this invention described later on. The output voltage from the adder 2 is applied to a voltage controlled oscillator (VCO) 3 to generate a frequency corresponding to the applied voltage. The output Y from the voltage controlled oscillator 3 is provided to the automatic tuning device of this invention and, at the same time, to a voltage controlled filter (VCF) 4 to achieve tone control. A tone signal derived from the voltage controlled filter 4 is amplitude controlled, by a voltage controlled amplifier (VCA) 5, for input to a sound system 6, which reproduces the selected musical tone.

The keying signal from the keyboard circuit 1 is applied to control signal generators 7 and 8 to derive therefrom control signals for controlling the voltage controlled filter 4 and the voltage controlled amplifier 5, respectively.

Figure 2:
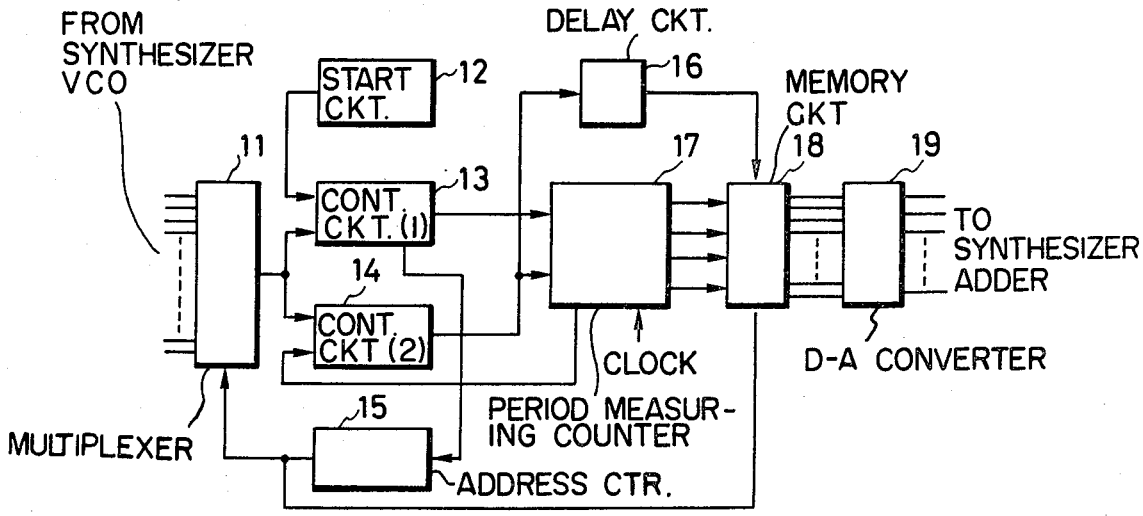
FIG. 2 is a block diagram illustrating the construction of an embodiment of this invention.

FIG. 2 is a block diagram illustrating the construction of the automatic tuning device in accordance with an embodiment of this invention. The outputs Y from the voltage controlled oscillators 3 of a plurality of such synthesizers as shown in FIG. 1 are applied to a multiplexer 11, by which the synthesizers are selected one by one. A start circuit 12 provides a start signal for starting automatic tuning, which signal is applied to a control circuit (1)13 and added therein to the output from the multiplexer 11, and the output from the control circuit (1)13 is provided to a period measuring counter 17 to enable it. Supplied with the output branched from the multiplexer 11 and an output signal derived from the period measuring counter 17 when its counting started upon occurrence of the start signal from the start circuit 12 has reached a preset value, a control circuit (2)14 produces a stop signal for stopping the counting of the period measuring counter 17. The control signal from the control circuit (1)13 is applied to an address counter 15, from which are supplied to the multiplexer 11 and a memory circuit 18 signals for selecting the plurality of synthesizers one by one. The stop signal from the control circuit (2)14 to the period measuring counter 17 is branched for input to a delay circuit 16 to provide therefrom a latch signal to the memory circuit 18. The period measuring counter 17 measures the period of the signals from each synthesizer under the control of the control circuits (1)13 and 14 and provides, in the form of a 4-bit binary number, the measured output which is derived as an error signal on the principles described in detail later on. The output from the period measuring counter 17 is applied to the memory circuit 18, in which it is stored by the latch signal from the delay circuit 16 at an address assigned by the address counter 15. The output from the memory circuit 18 is provided to a D-A converter 19 for conversion into an analog form. The error signal now converted by the D-A converter 19 into the analog form is applied as the synthesizer input X to the adder 2 in FIG. 1 for addition to the aforesaid pitch determining voltage signal, thereby carrying out automatic tuning. In this instance, the ouput Y applied to the tuning device from the voltage controlled oscillator 3 is, for example, an oscillation frequency when the pitch determining voltage signal from the keyboard circuit 1 is fixed at 0V in FIG. 1.

Figure 3:
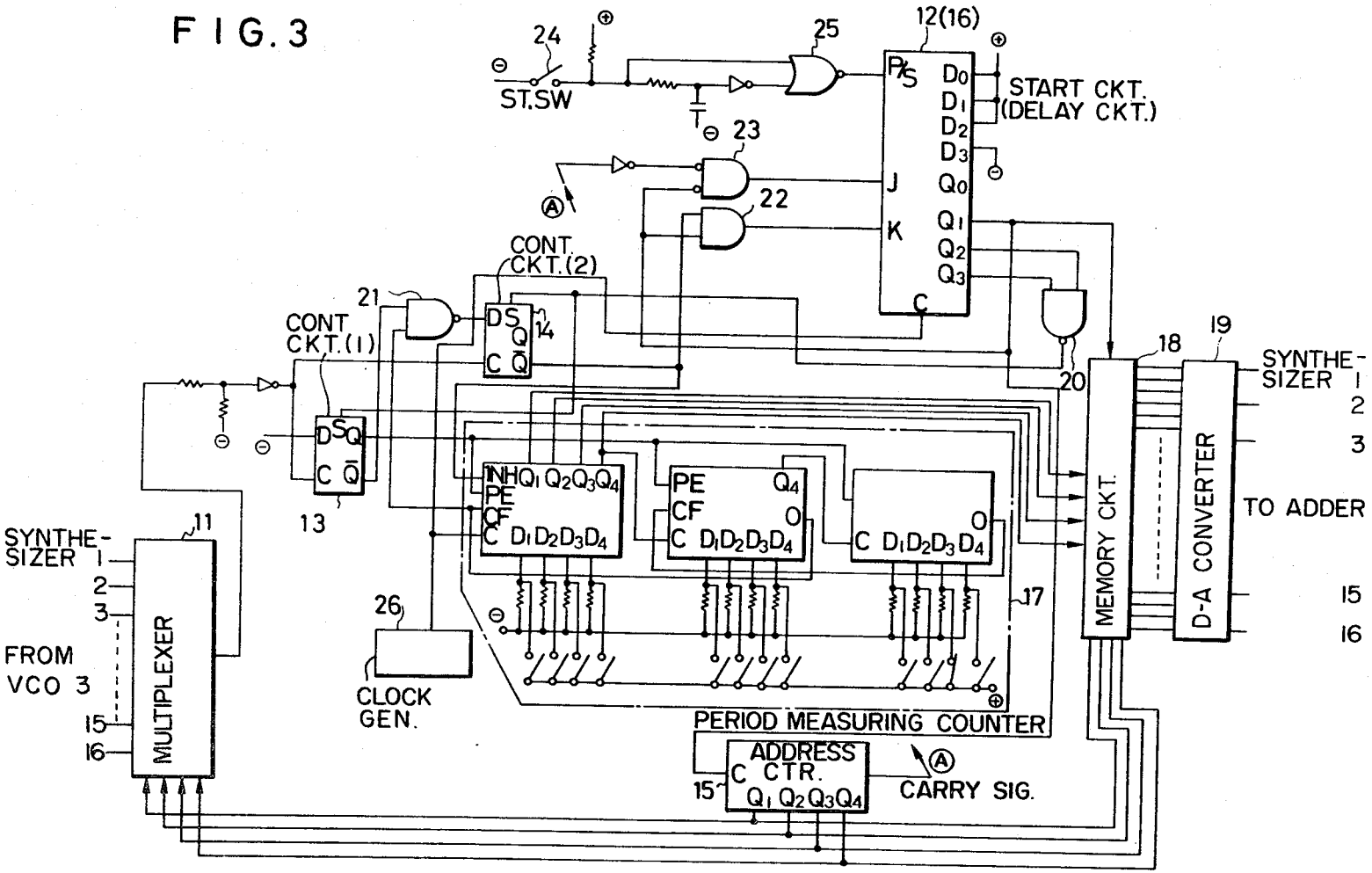
FIG. 3 is a detailed circuit diagram of the embodiment shown in FIG. 2.

FIG. 3 illustrates in detail the circuit construction of the automatic tuning device depicted in FIG. 2, and FIG. 4 is a timing chart showing its operation.

Although FIG. 3 shows, by way of example, a device for tuning sixteen synthesizers, tuning of a desired number of synthesizers can be achieved by changing the bit numbers of the address counter 15, the multiplexer 11, the memory circuit 18 and the D-A converter 19.

Figure 4A:
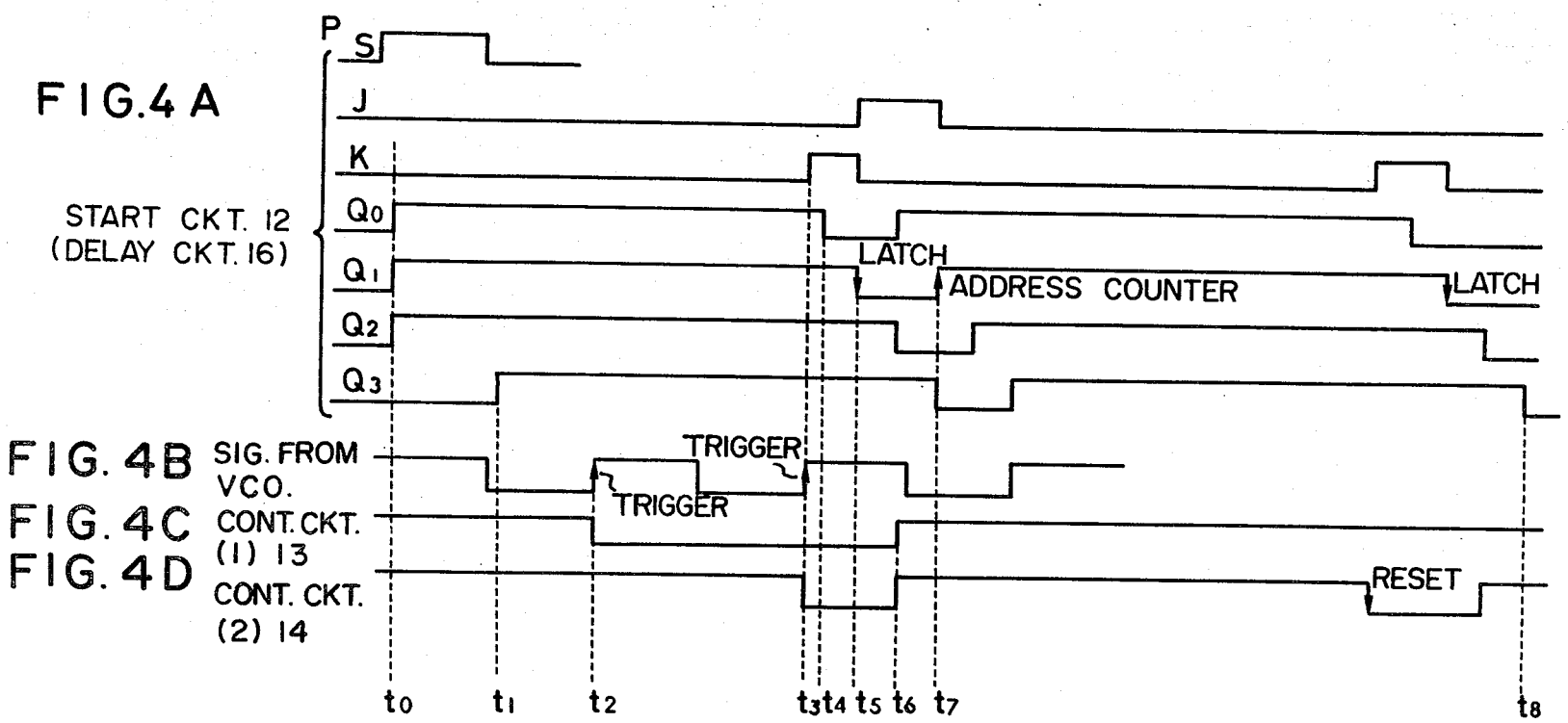
FIG. 4 is a timing chart explanatory of the operation of the circuit depicted in FIG. 3.

Upon depression of a tuning start switch (ST.SW)24, a voltage ⊕ is grounded ⊖ via a resister, and one end of the switch 24 is branched into two; namely one is connected directly to the input of a NOR circuit 25 and the other connected thereto via an integrator circuit and a NOT circuit, forming a pulse generator circuit. By applying the output from the NOR circuit 25, that is, a start signal P/S shown in FIG. 4A, to the start circuit 12 including the delay circuit 16, "0111" is read in an output "$D_3D_2D_1D_0$" of the start circuit 12 to provide "0111" at its outputs $Q_3$ through $Q_0$, as shown. Accordingly, the output from a NAND circuit 20 is "1," and "1" is applied to a terminal S of a D flip-flop forming the control circuit (1)13, so that its output Q is "1," and the period measuring counter 17 is in its inoperative state at moments $t_0$ to $t_1$, as shown in FIG. 4. Upon application of a clock from a clock generator 26 to the start circuit 12 at the moment $t_1$, "1" is applied as information to the start circuit 12 to shift it since terminals J and K are both "0" at this moment. As a result of this, the "1111" is provided at the outputs $Q_3$ through $Q_0$. At this time, the NAND circuit 20 provides an output "0," which is applied to the terminal S of the control circuit (1)13 to enable it. Upon application of a first tone signal from the voltage controlled oscillator after the control circuit (1)13 has been put in its operable state, the control circuit (1)13 is inverted at a moment $t_2$ to provide "0" at its output Q as shown in FIGS. 4B and 4C. Consequently, "0" is applied to a terminal PE of the period measuring counter 17 to cause it to start counting with the clock from the clock generator 26. A presettable counter is used as the period measuring counter 17, under which preset switches are provided. Let it be assumed that the period measuring counter 17 is supplied with a preset input "0100 0000 0000" and starts downcounting with this value. When eight high-order bits have all become "0" in the course of counting, "1" is inputted to one terminal of a NAND circuit 21. At this time, "1" is already provided at a terminal $\overline{Q}$ of the control circuit (1)13, so that the control circuit (2)14 becomes operable. Upon application of first tone signal from the voltage controlled oscillator after the control circuit (2)14 has become operable, it is inverted at a moment $t_3$ to produce "1" at its output $\overline{Q}$, as shown in FIGS. 4B and 4D. As a result of this, "1" is inputted to a terminal INH of the period measuring counter 17 to stop its counting. Further, the information at the terminal $\overline{Q}$ of the control circuit (2)14 is applied to an AND circuit 22 to provide "1" at a terminal K of the start circuit 12, so that, by the clock input to the start circuit 12, "0" is read therein to shift it, providing an output "1110" at the outputs $Q_3$ through $Q_0$ at moments $t_4$ to $t_5$, as depicted in FIG. 4A. By the fall of the output $Q_1$, that is, its change from "1" to "0," in this case, information of four low-order bits of the period measuring counter 17 is stored in the memory 18. At this time, since the output $Q_1$ is "0," "1" is inputted by an AND circuit 23 to the terminal J. Accordingly, by the subsequent clocks, "1" is read in the start circuit 12 to shift it, and the output changes to "1001," "0011," . . . "1111." In this case, as shown at a moment $t_7$ in FIG. 4, by the change of the output $Q_1$ from "0" to "1," the address of the address counter 15 is advanced by one in preparation for the tuning of the next synthesizer.

Upon completion of tuning of all the synthesizers, the address counter 15 produces a carry signal, so that the output from the AND circuit 23 does not become "1," that is, "1" is not applied to the terminal J of the start circuit 12, as mentioned above. Accordingly, after "1" is applied to the terminal K, "0" s are read in the start circuit 12 one after another to shift it to provide "0000" at the outputs $Q_3$ through $Q_0$, thus completing the tuning. This is indicated by the fall of the output $Q_3$ at a moment $t_8$ in FIG. 4A.

Turning now to FIGS. 5 and 6, the principles of the automatic tuning of this invention will hereinbelow be described in detail. FIGS. 5A, 5B and 5C show the relationship between tone signals from the voltage controlled oscillators of two synthesizers and the clock. In FIG. 5A, the period measuring counter starts counting with the clock of FIG. 5B upon rising of a tone signal of a first synthesizer at a moment $t_a$, and the period measuring counters stops its counting with the rising of the next tone signal at a moment $t_{b1}$ a period $t_c$ after the high-order bits of the counter except four low-order bits have all become "0." And information $D_1$ of the four low-order bits at this time is picked up as an error signal. In FIG. 5C, information $D_2$ is similarly picked up as an error signal in respect of a second synthesizer at a moment $t_{b2}$. The error signals thus obtained are applied to the adder 2 in FIG. 1, by which the two synthesizers are tuned to oscillate at the same frequency.

Figure 7:
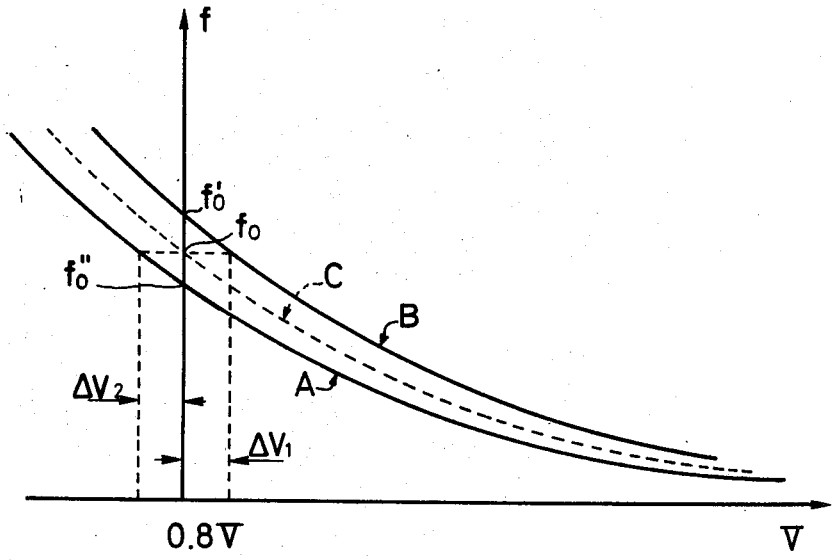

This will hereinunder be described in detail with reference to FIG. 7. FIG. 7 shows input-output characteristic of the voltage controlled oscillator in the case where it is tuned and not tuned to a predetermined frequency. For convenience of description, let it be assumed that the voltage controlled oscillator oscillates at a reference frequency $f_0$ when its input voltage is 0.8V and that the output voltage from the keyboard circuit is 0V during tuning.

In the state in which the voltage controlled oscillator is tuned, its input-output characteristic is given as follows:

$$f = f_0 \cdot 1^{-a(V-0.8)}$$

where a and $f_0$ are constants (the curve C in FIG. 7), and the input voltage is 0.8V, and $f = f_0$. On the other hand, if the preset value of the period measuring counter 17 is "0100 0000 0000" (1024 in the decimal notation) as mentioned previously, and if one period of the clock 26 is assumed to be $t_0$ (sec), $$f = 1/(1{,}016 \times t_0)$$

is set to be equal to $f_0$ mentioned above. In other words, when the period measuring counter has carried out down-counting and stopped with all the eight high-order bits "0" and the four low-order bits "1000," the voltage controlled oscillator is oscillating at the reference frequency $f_0$. In this instance, an analog value converted from "1000," for example, 0.8V is provided from the D-A converter (since the output from the keyboard circuit is 0V) and applied to the voltage controlled oscillator to cause it to oscillate at the reference frequency $f_0$. If a keyboard voltage is changed in this state, the voltage controlled oscillator oscillates following the curve C in FIG. 7. In the case where the voltage controlled oscillator is thus tuned, $D_1=8\times t_0$ and $d_1=0$ in FIG. 5A.

Next, let it be assumed that the voltage controlled oscillator of the synthesizer has got out tune and that its input-output characteristics has become as follows:

$$f=f_0\cdot l^{-a(V-0.8-\Delta V1)}$$

(the curve B in FIG. 7). In this case, even if the input voltage to the voltage controlled oscillator is 0.8V, $f=f_0'=f_0\cdot 1^{+a\cdot\Delta V1}$, producing an error $(f_0'-f_0)$. This error corresponds to $d_1$ in FIG. 5A. If the keyboard voltage is changed in this state, the oscillation frequency varies with the curve B in FIG. 7. In this instance, it is necessary that a voltage $(0.8+\Delta V_1)V$ be provided from the D-A converter, and $D_1$ in FIG. 5A corresponds to this value. By applying the voltage $(0.8+\Delta V_1)V$ to the voltage controlled oscillator, its oscillation frequency surely becomes $f_0$.

In this case, the four low-order bits of the period measuring counter stop, for example, at "1010," and an analog value converted therefrom becomes 1.0V, for instance. Applying this voltage to the input of the voltage controlled oscillator, the oscillator oscillates at the reference frequency $f_0$. In other words, the input-output characteristic indicated by the curve C in FIG. 7 is provided, and the voltage controlled oscillator is tuned.

Assume that the voltage controlled oscillator of the synthesizer has become out of tune and that its input-output characteristic has become as follows:

$$f=f_0\cdot l^{-a(V-0.8+\Delta V2)}$$

(the curve A in FIG. 7). In this case, even if the input voltage to the voltage controlled oscillator is 0.8V, $f=f_0''=f_0\cdot l^{-a\cdot\Delta V2}$, producing an error $(f_0''-f_0)$. This error corresponds to $d_2$ in FIG. 5C. In this instance, it is necessary that a voltage $(0.8-\Delta V_2)V$ be provided from the D-A converter, and $D_2$ in FIG. 5C corresponds to this value.

In such a case, the four low-order bits of the period measuring counter stop, for example, at "0101," and an analog value converted therefrom becomes 0.5V, for instance. Applying this voltage to the voltage controlled oscillator, the oscillator oscillates at the reference frequency $f_0$. In other words, the input-output characteristic of the curve C in FIG. 7 is provided; namely the voltage controlled oscillator is tuned to the reference frequency $f_0$.

Further, it is evident from FIGS. 6A and 6B that this invention enables tuning with the same accuracy regardless of feet ratios selected for the synthesizers. That is to say, FIGS. 6A and 6B show the cases where 16 and 8 feet ratios are selected, respectively, and indicate that frequency errors in the both cases are equal to each other. The reason is as follows:

The error in the case of the 16 feet ratio being selected is $\delta/T_2+\delta$ and the error in the case of the 8 feet ratio is $\delta/2T_1+\delta=\delta/2)/(T_1+\delta/2')$ so that the errors (frequency errors) with respect to the both periods ($T_1$ and $T_2$, respectively,) are equal to each other. $\delta$ is the length of one clock period of the maximum. It is understood that tuning can be achieved with the same accuracy regardless of the feet ratios being selected. However, it is necessary to preset the period measuring counter so that the range of 16 counts of the last four low-order bits of the period measuring counter corresponds to the lowest one of the selected feet ratios, that is, an integral multiple of the 16 feet in this case. As a result of this, all the feet ratios are represented by integral fractions of the 16 feet, such as $8'=16'/2$, $5\frac{1}{3}'=16'/3'$, $4'=16'/4$, $2\frac{2}{3}'=16'/6$, . . . . . , so that tuning is possible irrespective of any feet ratios.

In the above, tuning cannot be carried out unless the error of the oscillation period of the synthesizer to be tuned lies in the range of 16 counts of the clock in respect of the 16 feet ratios. In practice, however, since there is no synthesizer having such a tuning error, no problems arise. As for the accuracy of tuning, the error is one clock period at the greatest, so that even if the clock frequency is selected to be 2MHz, tuning can be effected with appreciably high accuracy.

As has been described in the foregoing, according to this invention, an error signal with respect to a preset value is obtained in a digital form by the period measuring counter from a tone signal of the voltage controlled oscillator and converted into an analog form for automatic tuning. The tuning device is completely digitalized in its principal part, and hence can be fabricated as an integrated circuit at low cost. Further, since the error signal after tuning is provided to have as small a number of bits as four, the D-A converter can also be simplified in construction. On top of that, this invention exhibits the advantage that tuning can be performed with the same accuracy regardless of the feet ratios selected for individual synthesizers.

It will be apparent that many modifications and variations may be effected without departing from the scope of the novel concepts of this invention.

What is claimed is:

1. An automatic tuning device in which an error signal is produced corresponding to an output tone signal from a voltage controlled oscillator and added to the input thereto which comes from a keying circuit of an electronic musical instrument, for automatic tuning, the automatic tuning device comprising, a clock, a period measuring counter which is controlled to start counting the clock output when the output tone signal from the voltage controlled oscillator has reached a predetermined level for the first time after input of a start signal to generate a control signal when the counting has reached a preset value and to stop the counting of the clock output when the output tone signal from the voltage controlled oscillator has reached a predetermined level for the first time after the generation of the control signal, the count value of the period measuring counter at the time of stopping the counting is converted into an analog form to provide the error signal.

2. An automatic tuning device in which an error signal is produced corresponding to an output tone signal from each of a plurality of voltage controlled oscillators and added to the input thereto which comes from a keying circuit of an electronic musical instrument, for automatic tuning, the automatic tuning device comprising a selector circuit for selecting from tone signal inputs from the plurality of voltage controlled oscillators a tone signal of an address assigned by an address counter; a clock, a period measuring counter which is controlled to start counting the clock output when the output signal from the selector circuit has reached a predetermined level for the first time after input of a start signal, to generate a control signal when the counting has reached a preset value and to stop the counting of the clock output when the output signal from the selector circuit has reached a predetermined level for the first time after the generation of the control signal; and a memory circuit for storing the count value of the period measuring counter at the time of stopping the counting at an address assigned by the address counter, the count value stored in the memory circuit being converted into an analog form to provide an error signal of a designated one of the voltage controlled oscillators.

3. An automatic tuning device as in claim 1 or 2, wherein said voltage controlled oscillators are part of tone synthesizers, and wherein said period measuring counter is preset such that the range of counts between said control signal and said preset value corresponds to the lowest one of the selected feet ratios of the synthesizers.

* * * * *